US011666142B2

(12) United States Patent
Heyring

(10) Patent No.: US 11,666,142 B2
(45) Date of Patent: Jun. 6, 2023

(54) STABILISING ARRANGEMENTS

(71) Applicant: No Rock Cafe Tables Pty Ltd, Eagle Bay (AU)

(72) Inventor: Toby William Heyring, Eagle Bay (AU)

(73) Assignee: No Rock Cafe Tables Pty Ltd, Eagle Bay (AU)

( * ) Notice: Subject to any disclaimer, the term of this patent is extended or adjusted under 35 U.S.C. 154(b) by 99 days.

(21) Appl. No.: 17/268,710

(22) PCT Filed: Sep. 10, 2019

(86) PCT No.: PCT/AU2019/050972

§ 371 (c)(1),
(2) Date: Feb. 16, 2021

(87) PCT Pub. No.: WO2020/051636

PCT Pub. Date: Mar. 19, 2020

(65) Prior Publication Data

US 2021/0186207 A1 Jun. 24, 2021

(30) Foreign Application Priority Data

Sep. 10, 2018 (AU) ..... 2018903394

(51) Int. Cl.

| | |
|---|---|
| ***A47B 21/02*** | (2006.01) |
| ***A47B 13/02*** | (2006.01) |
| *A47B 91/16* | (2006.01) |

(52) U.S. Cl.

CPC ..... *A47B 21/02* (2013.01); *A47B 13/02* (2013.01); *A47B 91/16* (2013.01); *A47B 2200/0013* (2013.01); *A47B 2200/0029* (2013.01)

(58) Field of Classification Search

CPC ..... A47B 21/02; A47B 13/02; A47B 91/06; A47B 2200/0013; A47B 2200/0029

(Continued)

(56) References Cited

U.S. PATENT DOCUMENTS 3,080,067 A * 3/1963 Lind ..... A47F 5/04 248/188.8
3,206,150 A * 9/1965 Lang ..... F16M 11/22 248/188.7

(Continued)

FOREIGN PATENT DOCUMENTS

FR 2580481 A1 10/1986
FR 2607878 A1 6/1988

(Continued)

*Primary Examiner* — Jose V Chen
(74) *Attorney, Agent, or Firm* — Charles H Jew

(57) ABSTRACT

A support arrangement (1) for an object (2), comprising primary frame (10), at least three pivoting members (21, 22, 25) and first, second, third and fourth feet (31, 32, 33, 34) fixed to the three pivoting members. The primary frame includes longitudinally spaced first and second stem portions (11, 12) fixed to a longitudinal member (13). The first and fourth feet are laterally spaced and positioned towards a first end of the primary frame and the second and third feet being laterally spaced and positioned towards a second end of the primary frame, the second and third feet being longitudinally spaced from the first and fourth feet. At least one interaction arrangement (50) provides interaction between the three pivoting members such that the four feet can move to accommodate or engage an uneven surface while maintaining control of the object in a position parallel to the average ground plane.

18 Claims, 11 Drawing Sheets

(58) Field of Classification Search
USPC ..... 108/144.11, 147.11, 147.9; 248/188.2, 248/188.8
See application file for complete search history.

(56) References Cited

U.S. PATENT DOCUMENTS

| | | | | |
|---|---|---|---|---|
| 4,135,690 | A * | 1/1979 | Clarke | A47B 91/10 248/188.8 |
| 4,754,713 | A * | 7/1988 | Chatenay epouse Compagnone | A63J 1/00 108/147 |
| 4,925,137 | A * | 5/1990 | Hastings | F16M 11/242 126/30 |
| 5,690,303 | A | 11/1997 | Winters | |
| 6,892,859 | B2 | 5/2005 | van der Pol | |
| 7,930,980 | B2 * | 4/2011 | Brooke | A47B 91/16 248/188.7 |
| 8,607,715 | B2 | 12/2013 | Catoni | |
| 8,695,931 | B2 * | 4/2014 | Hall | A47J 37/0786 248/188.7 |
| 8,876,071 | B2 * | 11/2014 | Brooke | A47B 91/16 248/188.8 |
| 9,949,565 | B1 * | 4/2018 | Huang | A47B 91/00 |
| 10,295,311 | B1 * | 5/2019 | Trubacek | A47B 37/00 |
| 10,342,328 | B2 | 7/2019 | Rafii | |
| 2015/0313358 | A1 * | 11/2015 | Heyring | A47B 13/021 248/188.2 |
| 2016/0029784 | A1 * | 2/2016 | Pike | A47B 13/021 248/188.9 |
| 2017/0000255 | A1 * | 1/2017 | Herring | A47C 16/02 |
| 2019/0082823 | A1 * | 3/2019 | Applegate | A47B 1/08 |

FOREIGN PATENT DOCUMENTS

| | | | | |
|---|---|---|---|---|
| FR | 2902620 | A1 | 12/2007 | |
| WO | 2000069312 | A1 | 11/2000 | |
| WO | WO-0113762 | A1 * | 3/2001 | A47B 3/08 |
| WO | WO-2018093323 | A1 * | 5/2018 | A47B 1/08 |
| WO | WO-2020051636 | A1 * | 3/2020 | A47B 13/02 |

* cited by examiner

STABILISING ARRANGEMENTS

FIELD OF THE INVENTION

The present invention relates to arrangements for supporting objects and specifically relates to self-stabilising supporting arrangements.

BACKGROUND

There are known a number of different types of self-stabilising base for supporting an object such as a table top. Self-stabilising bases allow the four feet of a supporting arrangement to conform to an uneven or warped ground surface. The majority of self-stabilising arrangements are for tables having a single stem or for tables having four legs extending from adjacent to the table top down to the ground. For example, U.S. Pat. No. 5,690,303 shows a table top supported by a stem, the lower end of which has two fixed feet and two moveable feet. The two fixed feet are provided by fixed U-shaped (in plan view) leg member that is permanently and rigidly fixed to the stem. The two moveable feet are provided by moveable U-shaped leg member that is pivotally connected to the stem. When the support arrangement is placed on an uneven surface, the angle of the table top in roll is fixed by the vertical positions of the two feet on the fixed U-shaped leg member. Warp of the ground surface is entirely accommodated by rotation of the two moveable feet as the moveable U-shaped leg member rotates to allow the feet to contact the uneven ground surface. This effectively provides a three-point support with the two fixed feet being two of the points, with the third point being midway between the two movable feet. This can provide an exaggerated roll or pitch of the table top as the table top is not maintained parallel to the average ground plane.

French patent publication number 2 607 878 and the applicant's U.S. Pat. No. 8,607,715 both show pedestal type support arrangements which maintain the table top parallel to an average ground plane generated through the four contact points of the feet with the ground. The stem extends upwards from a base in or around which four individual leg members are pivotally connected, the leg members having a foot at one end and having engagement locations either side of a pivot so that motion of one leg member causes motion of the other three leg members. This allows the feet of the arrangement to displace to conform to an uneven or non-planar ground surface while maintaining both vertical support and roll and pitch direction rotational support for the table top and maintains the table top parallel to the average ground plane. These arrangements are not readily suited to a twin pedestal type arrangement where the foot-print is rectangular and difference between the lengths of lateral and longitudinal legs would be extreme.

French patent publication number 2 902 620 shows a four-legged table including a mechanism to maintain the table top parallel to the average ground plane. The mechanism also uses multiple parallelograms to maintain the vertical orientation of the legs relative to the table top. This arrangement has manufacturing complexity and does not allow a twin pedestal design of support arrangement to be used.

U.S. Pat. No. 10,342,328 shows a twin pedestal base in which two feet are rigidly fixed relative to a first stem and the table top. The other two feet are fixed to each other and a pivoting portion of the second stem and can rotate relative to the table top, a fixed portion of the second stem and the fixed feet and first stem. Again this provides effectively a three-point support which does not maintain the table top parallel to an average ground plane through the four contact points of the four feet and can provide exaggerated roll of the table top on uneven ground.

SUMMARY OF THE INVENTION

According to a first aspect of the invention there is provided a support arrangement for an object, the support arrangement comprising: a primary frame, the primary frame including a first stem portion, a second stem portion and a longitudinal member, the second stem portion being longitudinally spaced from the first stem portion, the first and second stem portions being attached or fixed to the longitudinal member; first, second, third and fourth feet, each said foot attached to at least one of at least three pivoting members; in use, the first and fourth feet being laterally spaced and positioned towards a first end of the primary frame and the second and third feet being laterally spaced and positioned towards a second end of the primary frame, the second foot being longitudinally spaced from the first foot, the third foot being longitudinally spaced from the fourth foot; at least one interaction arrangement providing interaction between the at least three pivoting members and being arranged such that when the first foot moves in a first upwards or downwards direction relative to the primary frame the second foot moves in at least a second direction relative to the primary frame, the second direction being an opposite direction relative to the first direction, and the third leg moves in the first direction and the fourth leg moves in at least the second direction.

The support arrangement may thereby maintain the attitude of the object in an orientation substantially parallel to an average ground plane being a plane parallel to a first virtual line between the first and third feet, parallel to a second virtual line between the second and fourth feet, and intersecting a point midway between the shortest distance between the first and second virtual lines.

The invention thereby provides support of an object above the four contact points of the feet on an uneven surface and maintains orientation of the object substantially parallel to the average ground plane.

Beneficially, one or more forms of the present invention enables a support arrangement to be moved across an uneven surface, the support arrangement adjusting inherently to the uneven surface without requiring input from a user.

The first foot and the third foot may be on opposing sides of a virtual straight line extending between the second foot and the fourth foot.

The at least three pivoting members may comprise a first pivoting leg member pivotally connected to the primary frame at a first pivot, a second pivoting leg member pivotally connected to the primary frame at a second pivot and at least a first pivoting balance member pivotally connected to the primary frame at a third pivot; the first pivot being located at or towards the first end of the primary frame, the second pivot being located at or towards the second end of the primary frame and the third pivot being located between the first and the second pivot; the first foot being fixed to the first pivoting leg member, the second foot being fixed to the second pivoting leg member; the at least one interaction arrangement providing interaction between the first pivoting leg member and the first pivoting balance member and between the second pivoting leg member and the first pivoting balance member such that rotation of one of said three pivoting members results in a rotation of each of the three pivoting members.

The third foot may be fixed to the second pivoting leg member, and the fourth foot may be fixed to the first pivoting leg member. Alternatively, the third and fourth feet may be fixed to the first pivoting balance member.

In use, the first pivot may have a first pivot axis extending at least longitudinally, the second pivot may have a second pivot axis extending at least longitudinally, and the third pivot may have a third pivot axis extending at least vertically.

Alternatively, in use, the first pivot may have a first pivot axis extending at least longitudinally, the second pivot may have a second pivot axis extending at least longitudinally, and the third pivot may have a third pivot axis extending at least laterally.

For example, the longitudinal member of the primary frame may be located at an upper end of the first and second stem portions of the primary frame. In this case the third pivot axis may extend at least vertically, in use. Conversely, the longitudinal member of the primary frame may be located at a lower end of the first and second stem portions of the primary frame. The pivoting balance member may include a first pivoting balance member pivotally connected to the longitudinal member by the third pivot and a second pivoting balance member pivotally connected to the longitudinal member by a fourth pivot, the third and fourth pivots having pivot axes being aligned substantially horizontally in use and substantially perpendicular to first and second pivot axes of the respective first and second pivots. In this case the third pivot and fourth pivot axes may extend at least laterally.

The at least one interaction arrangement may include a protrusion slot arrangement between the first pivoting leg member and the first pivoting balance member either comprising a protrusion on the first pivoting leg member engaging with a slot, hole or recess in the first pivoting balance member; or comprising a protrusion on the first pivoting balance member engaging with a slot, hole or recess in the first pivoting leg member. The protrusion may be a ball.

Alternatively, the at least one interaction arrangement may include a protrusion arrangement between the first pivoting leg member and the first pivoting balance member either comprising at least one protrusion extending from the first pivoting leg member to bear on the first pivoting balance member or comprising at least one protrusion extending from the first pivoting balance member to bear on the first pivoting leg member.

The longitudinal member of the primary frame may be located at an upper end of the first and second stem portions of the primary frame. Alternatively, the longitudinal member of the primary frame may be located at a lower end of the first and second stem portions of the primary frame.

The at least a first pivoting balance member may include a first pivoting balance member pivotally connected to the longitudinal member by the third pivot and a second pivoting balance member pivotally connected to the longitudinal member by a fourth pivot, the third and fourth pivots having pivot axes being aligned substantially horizontally in use and substantially perpendicular to first and second pivot axes of the respective first and second pivots.

Alternatively the interaction arrangement may be a sliding chamfer arrangement comprising a rectangular channel, four corner blocks, two long sliding members, two short sliding members, and a guide having a rectangular channel formed by two long side channels and two short side channels with a first, second, third or fourth hole in each corner between a long side channel and a short side channel, each sliding member having a chamfer on each end and each corner block having a first and a second chamfer on adjacent edges of a first end, each sliding member being located in a respective long or short side channel and each corner block extending through the first, second, third or fourth hole, the first chamfer of each corner block being in contact with the chamfer on the end of one of the long sliding members and the second chamfer of each corner block being in contact with one of the chamfers on the end of one of the short sliding members, each second end of a corner block being in contact with one of the pivoting members.

In one or more forms of the present invention, the at least three pivoting members may comprise a first pivoting leg member pivotally connected to the primary frame at a first pivot, a second pivoting leg member pivotally connected to the primary frame at a second pivot, a third pivoting leg member pivotally connected to the primary frame at a third pivot and, a fourth pivoting leg member pivotally connected to the primary frame at a fourth pivot; each respective first, second third or fourth pivoting leg member including the respective foot; each respective first, second, third and fourth pivot having a respective pivot axis, each said pivot axis being substantially laterally oriented, the first and fourth pivot axes being substantially aligned and the second and third pivot axes being substantially aligned; the interaction arrangement comprising a first pivoting balance member arranged to rotate about a longitudinal rotation axis relative to the primary frame, the first pivoting balance member including a first lateral beam member and a second lateral beam member longitudinally spaced from the first lateral beam member, each lateral beam member including a first engaging region located on an opposite side of the longitudinal rotation axis to a second engaging region in plan view; the first and fourth pivoting leg members including an engagement region located on an opposite side of the first or fourth pivot axis to the respective first or fourth foot in plan view; the second and third pivoting leg members including an engagement region located between the second or third pivot axis and the respective second or third foot in plan view; the first engagement region of the first lateral beam member engaging in use with the engagement region of the first pivoting leg member, the first engagement region of the second lateral beam member engaging in use with the engagement region of the second pivoting leg member, the second engagement region of the second lateral beam member engaging in use with the engagement region of the third pivoting leg member, and the second engagement region of the first lateral beam member engaging in use with the engagement region of the fourth pivoting leg member.

In use, beyond an operational rotation of at least one of the three pivoting members, rotation of the three pivoting members may be limited by interference between at least one of the pivoting members and the primary frame. For example, beyond the operational rotation, the interference may be between the first pivoting leg member and the first stem portion of the primary frame and/or between the second pivoting leg member and the second stem portion of the primary frame. Alternatively, beyond the operational rotation, the interference may be between the first pivoting balance member and the longitudinal member of the primary frame.

The object to be supported may be a table top, cupboard, plant, speaker or any other object. If the object is a table top, the table top may be rotatable between a working position and a storage position. Alternatively or additionally, the table top may be height adjustable. For example, the support arrangement may provide a sit-to-stand type desk.

Another aspect of the present invention provides a twin pedestal support for a table top, the twin pedestal support comprising a primary frame, three pivoting members, and first, second, third and fourth feet; the primary frame including a first stem portion at a first end of the primary frame, a second stem portion at a second end of the primary frame and a longitudinal member connected to the first stem portion and to the second stem portion; the first, second, third and fourth feet each being connected to one of pivoting members of the three pivoting members; in use, the first and fourth feet being positioned towards the first end of the primary frame and the second and third feet being positioned towards the second end of the primary frame, the second foot being longitudinally spaced from the first foot, the third foot being longitudinally spaced from the fourth foot and being laterally and longitudinally spaced from the first foot, at least one interaction arrangement providing interaction between the at least three pivoting members and being arranged such that when the first foot moves in a first upwards or downwards direction relative to the primary frame the second foot moves in at least a second direction relative to the primary frame, the second direction being an opposite direction relative to the first direction, and the third leg moves in the first direction and the fourth leg moves in at least the second direction.

Another aspect of the present invention provides a twin pedestal support for a table top, the twin pedestal support comprising a primary frame, three pivoting members, and first, second, third and fourth feet; the primary frame including a first stem portion at a first end of the primary frame, a second stem portion at a second end of the primary frame and a longitudinal member connected to the first stem portion and to the second stem portion; in use, the first and fourth feet being positioned towards the first end of the primary frame and the second and third feet being positioned towards the second end of the primary frame, the second foot being longitudinally spaced from the first foot, the third foot being longitudinally spaced from the fourth foot and being laterally and longitudinally spaced from the first foot, the three pivoting members comprise a first pivoting leg member pivotally connected to the primary frame at a first pivot, a second pivoting leg member pivotally connected to the primary frame at a second pivot and a pivoting balance member pivotally connected to the primary frame at a third pivot; the first pivot being located at or towards the first end of the primary frame, the second pivot being located at or towards the second end of the primary frame and the third pivot being located between the first and the second pivot; the first foot being fixed to the first pivoting leg member, the second foot being fixed to the second pivoting leg member; at least one interaction arrangement provides interaction between the first pivoting leg member and the pivoting balance member and between the second pivoting leg member and the pivoting balance member such that rotation of one of said three pivoting members results in a rotation of each of the three pivoting members.

One or more forms of the present invention may provide a twin pedestal support wherein the first foot and the third foot are on opposing sides of a virtual straight line extending between the second foot and the fourth foot.

It will be convenient to further describe the invention by reference to the accompanying drawings which illustrate preferred aspects of the invention. Other embodiments of the invention are possible and consequently particularity of the accompanying drawings is not to be understood as superseding the generality of the preceding description of the invention.

DESCRIPTION OF PREFERRED EMBODIMENT

Figure 1:
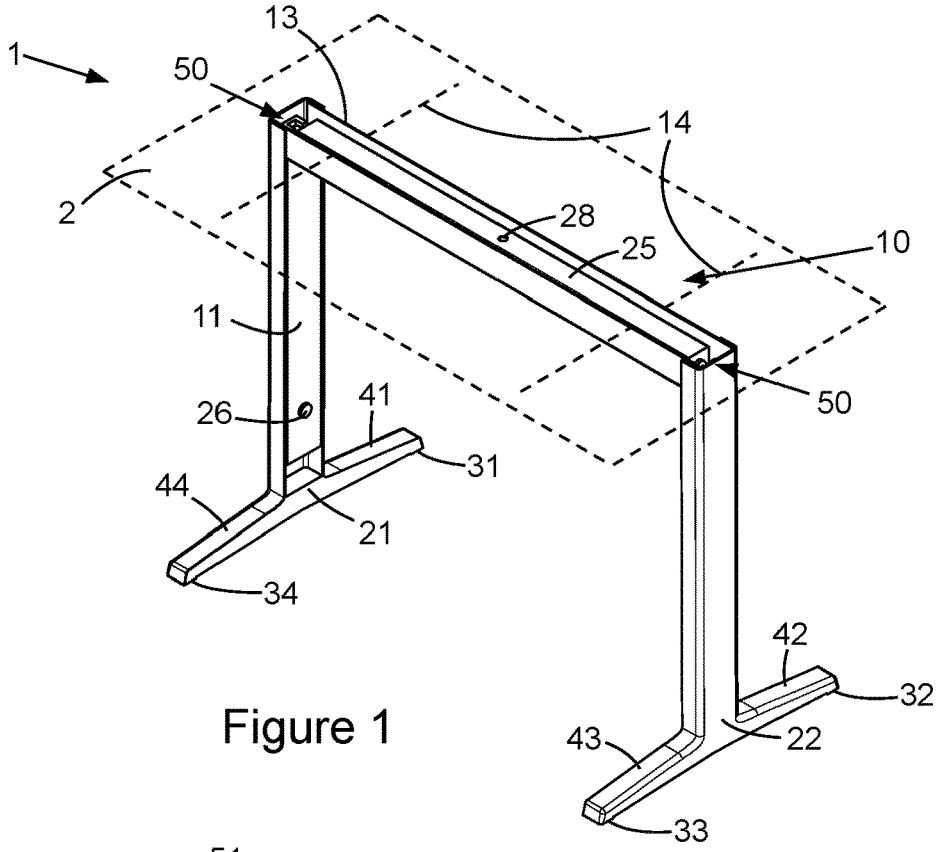
FIG. 1 is a perspective view of a support arrangement according to the present invention.

Referring initially to FIG. 1, there is shown a support arrangement 1 supporting an object 2, in this case a table top shown as transparent and outlined in dashed lines. The object is supported on the primary frame 10 and optional braces 14 are shown in dashed lines connected to the longitudinal member 13 of the primary frame 10 to spread the supporting loads wider under the object.

Figure 2:
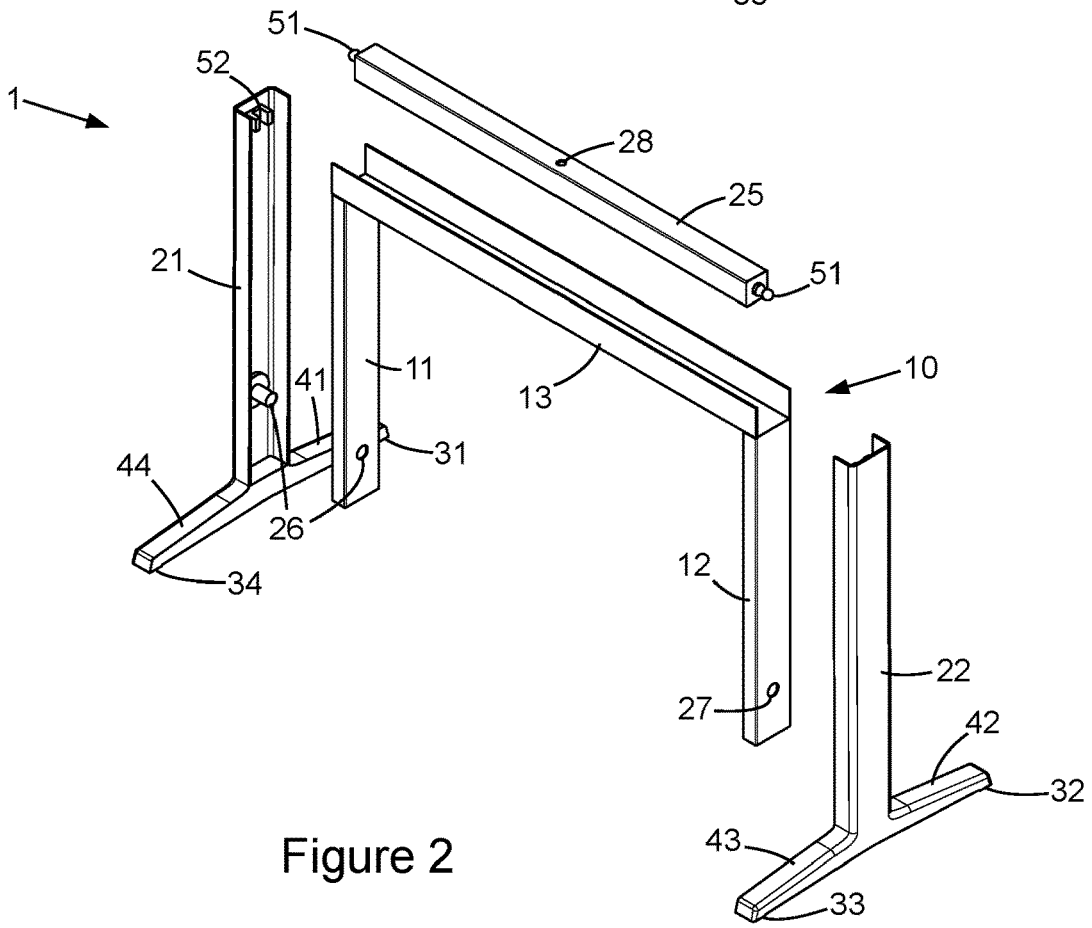
FIG. 2 is an exploded view of the support arrangement of FIG. 1.
Figure 3:
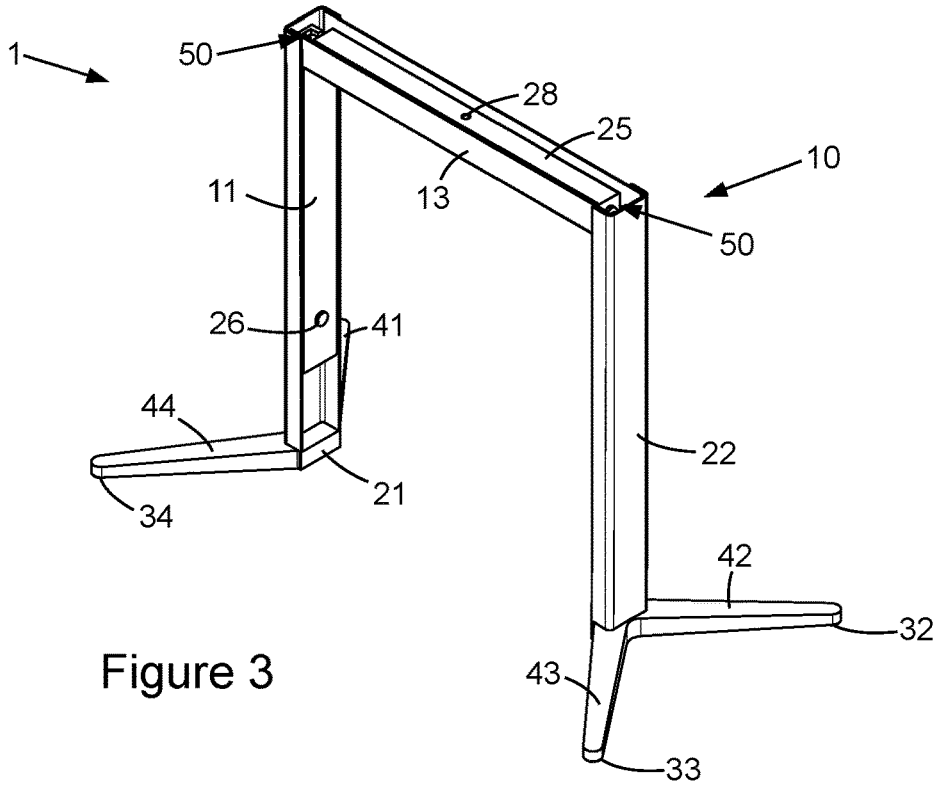
FIG. 3 is a perspective view of a support arrangement according to the present invention.
Figure 4:
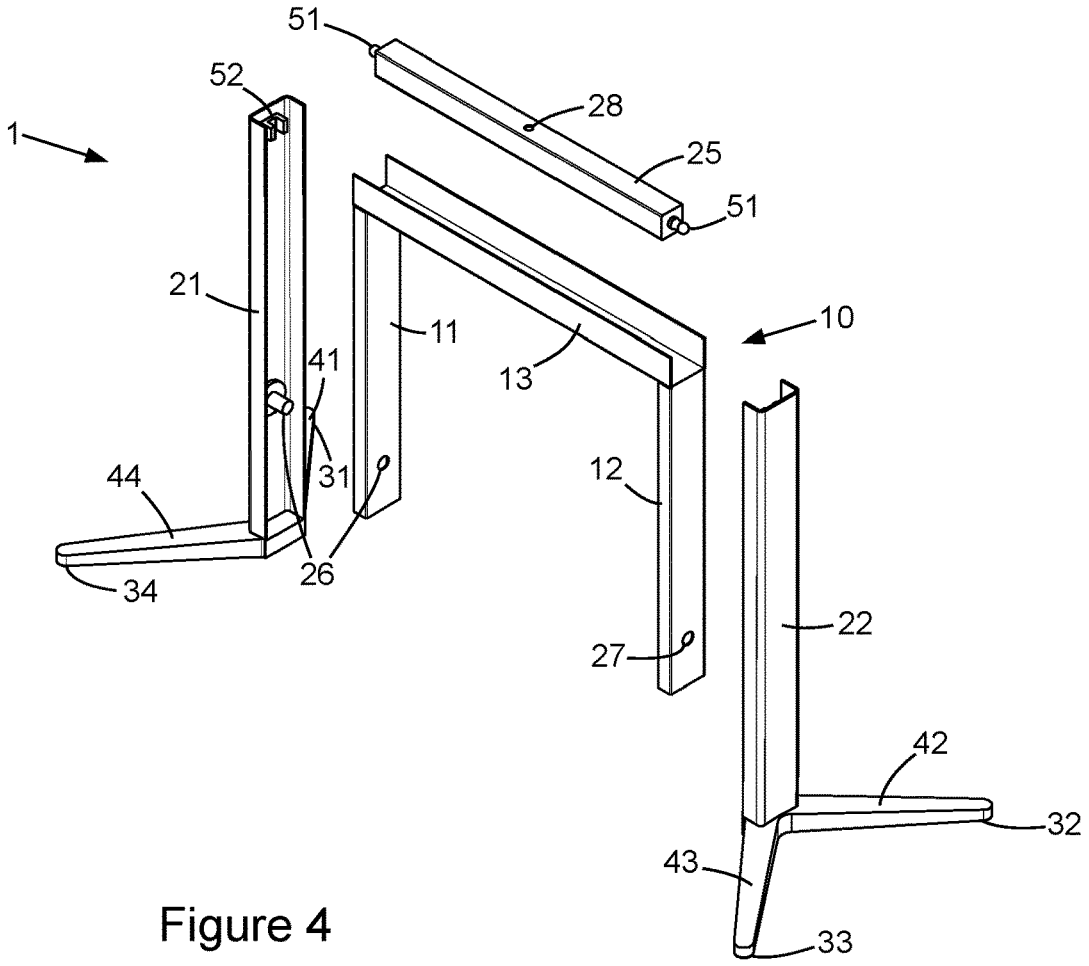
FIG. 4 is an exploded view of the support arrangement of FIG. 3.
Figure 5:
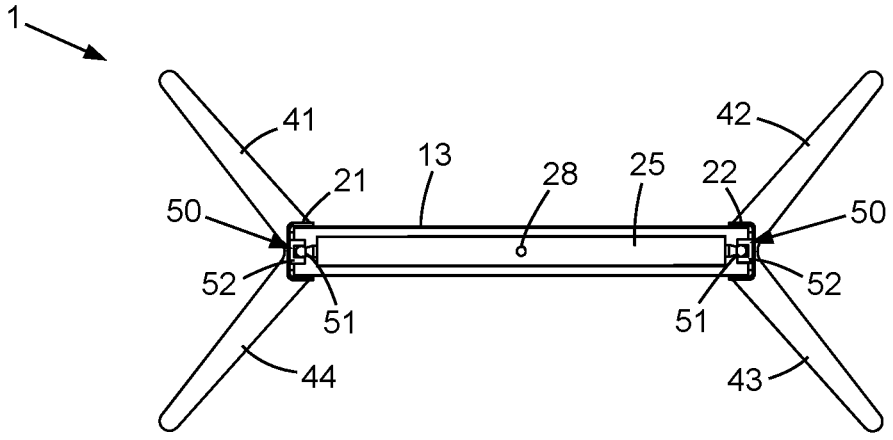
FIG. 5 is a plan view or top view of the support arrangement of FIG. 3.
Figure 6:
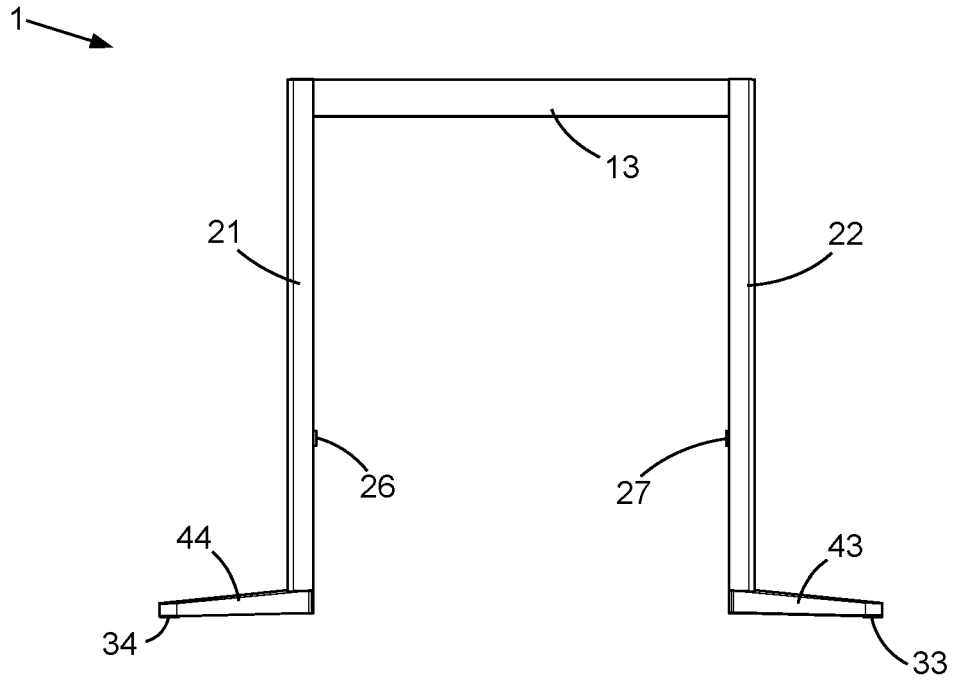
FIG. 6 is a side view of the support arrangement of FIG. 3.

As shown in FIG. 2, the primary frame includes a first stem 11 portion fixed at or near a first end of the longitudinal member 13 and a second stem portion 12 fixed at or near a second end of the longitudinal member 13. The first pivoting leg member 21 includes a first foot 31 at the end of a first arm portion 41 and a fourth foot 34 at the end of a fourth arm portion 44. A first pivot 26 provides a pivotal connection between the first pivoting leg member 21 and the primary frame 10. The second pivoting leg member 22 includes a second foot 32 at the end of a second arm portion 42 and a third foot 33 at the end of a third arm portion 43. A second pivot 27 provides a pivotal connection between the second pivoting leg member 22 and the primary frame 10.

As the primary frame can effectively pivot about an axis through the first and second pivots 26, 27, a mechanism is provided to prevent free rotation of the primary frame about the axis through the first and second pivots 26, 27. However the mechanism can permit the first pivoting leg member 21 to rotate in an opposite direction to the second leg member 22 to accommodate uneven surfaces under the four feet 31, 32, 33, 34. A pivoting balance member 25 is pivoted to the primary frame at third pivot 28 and preferably is located within a section of the longitudinal member 13 of the primary frame. The pivoting balance member 25 interacts with the first and second pivoting leg members are respective interaction arrangements 50 as shown in FIG. 1. As shown in FIG. 2, a ball or other protruding feature 51 can be provided on one of the parts with a recess 52, slot, hole or other receiving feature provided to receive the ball 51 or other protruding feature.

The pivots 26, 27 can utilise bolted connections and the tension in the bolts can be used to adjust damping of the rotation of the first and second pivoting leg members 21, 22 relative to the primary frame 10. This can prevent or substantially limit any small oscillations of the primary frame about the effective axis through the first and second pivots 26, 27 due to any clearances in the interaction arrangements 50 or in any of the pivots. 26, 27, 28, such clearances being desirable for assembly and for operation of the mechanism to self stabilise the support assembly under its own weight without requiring additional external input when the support assembly is moved, for example from a flat surface to a warped surface.

FIGS. 3 to 6 show a modification to the support arrangement of FIGS. 1 and 2. The first, second, third and fourth arm portions 41, 42, 43, 44 of the first and second pivoting leg members 21, 22 are angled such that the feet 31, 32, 33, 34 are not directly underneath the first and second pivots 26, 27 in side view as shown in the side view FIG. 6. One of the benefits of this is that the loads from the surface such as the ground, into the feet 31, 32, 33, 34 generate a moment in the pivots 26, 27 which can be reacted at least in part by contact between the upper portion of the first and second pivoting leg members 21, 22 against the first and second stem portions 11, 12 of the primary frame 10. Friction in these contacts between the pivoting leg members and the stem portions can provide damping of the rotation of the primary frame 10 relative to the first and second pivoting leg members 21, 22. The load at these contacts is dependent at least in part on the loads at the feet. So, when the base is being lifted and lower into position, the feet loads and therefore the friction between the pivoting leg members and the frame is low and the mechanism can readily self-adjust. But when the base is in position and fully weight bearing, the larger the load on the primary frame 10 trying to rotate it about the axis through the first and second pivots 26, 27, the larger the damping of that rotation.

Figure 7:
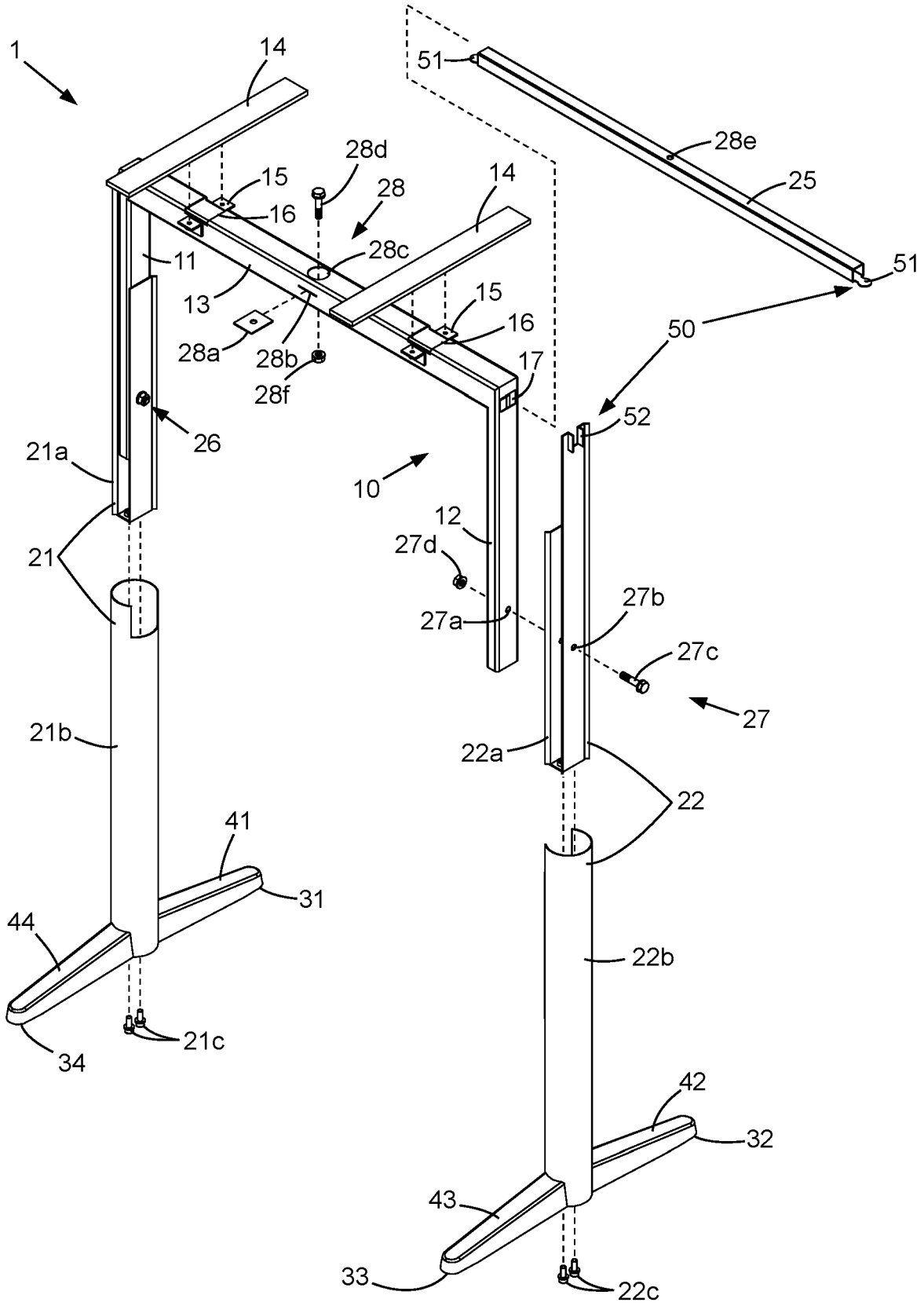
FIG. 7 is a partially exploded view of a support arrangement according to the present invention.
Figure 8:
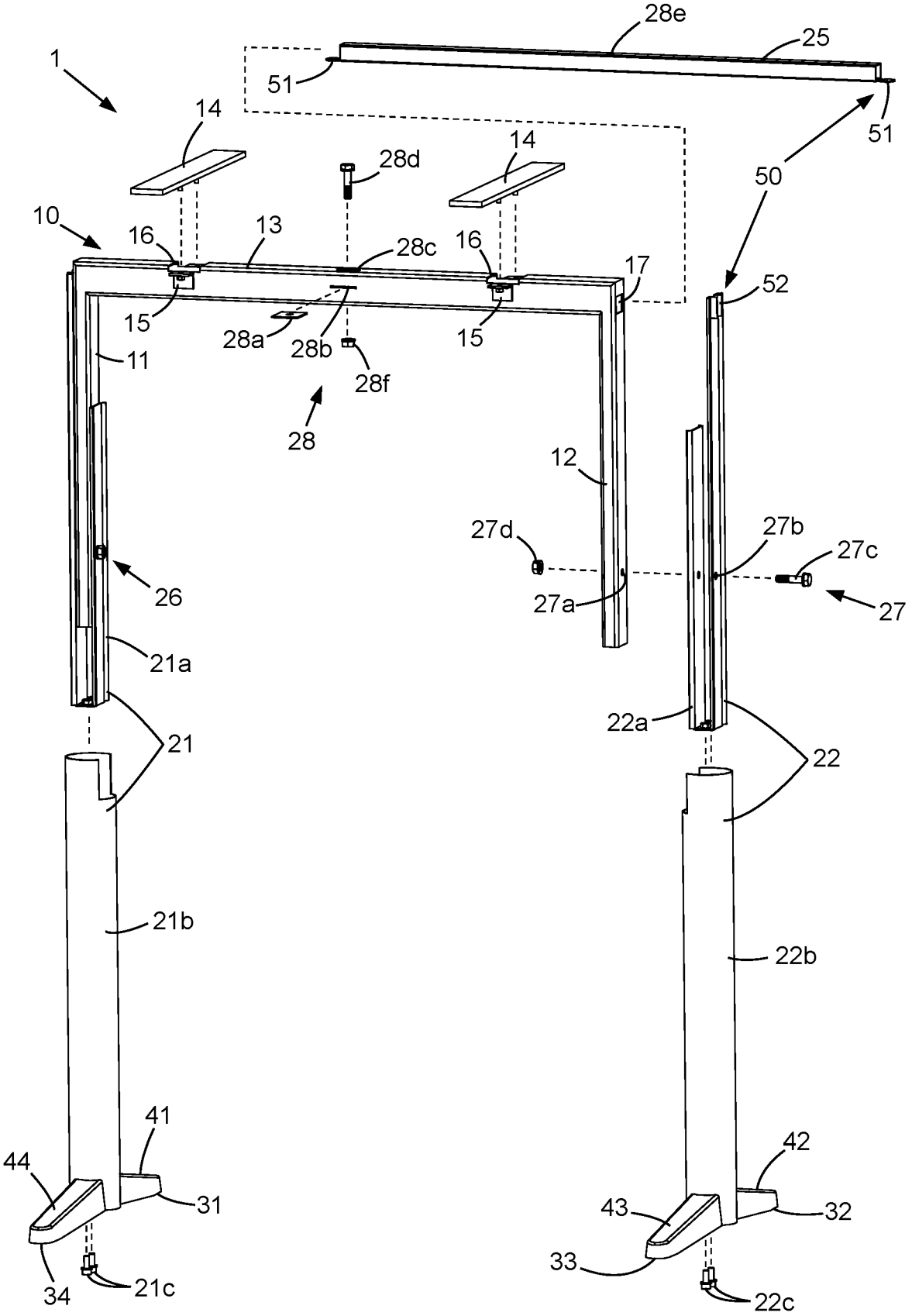
FIG. 8 is a partially exploded view of the support arrangement of FIG. 7.
Figure 9:
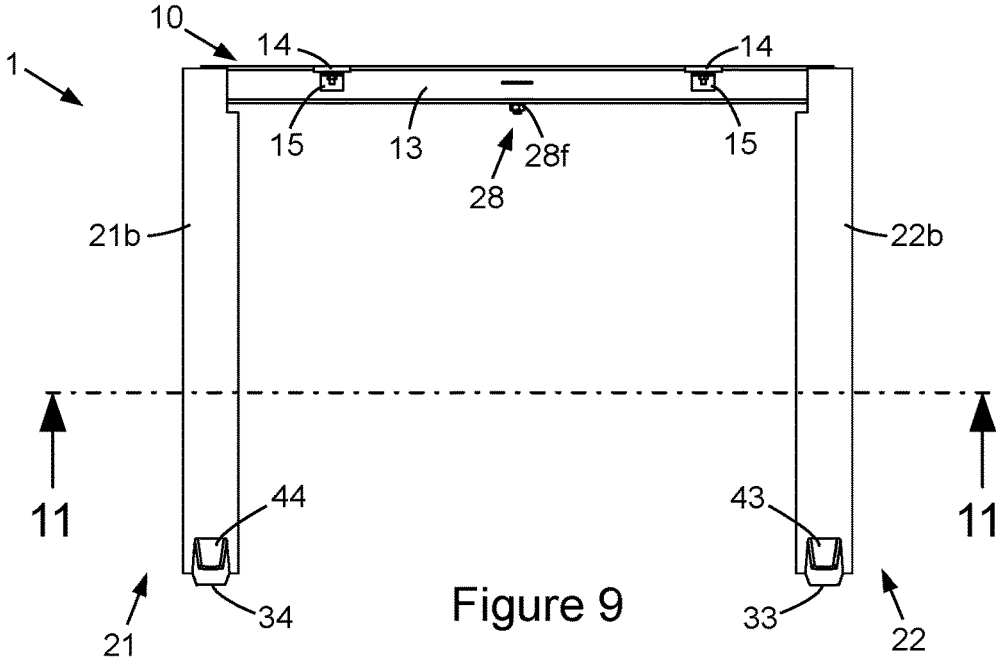
FIG. 9 is a side view of the support arrangement of FIG. 7.

FIGS. 7 to 10 show modifications to the support arrangement of FIGS. 1 and 2, but could also incorporate the angled first, second, third and fourth arm portions 41, 42, 43, 44 of the first and second pivoting leg members 21, 22 of FIGS. 3 to 6. The braces 14 to spread the supporting loads wider under the object are connected to the longitudinal member 13 of the primary frame 10 by fasteners. Ideally, the fasteners allow the braces 14 to be shipped disassembled from the primary frame and 10 and fastened to it before use. To this end, the braces shown incorporate stud bolts that can be fastened to brackets 15 by nuts. Alternatively, countersunk bolts can be used or other known types of fastener. The longitudinal member 13 of the primary frame 10 includes a notch or recess 16 to receive each brace 14 allowing the braces to sit flush with the top of the longitudinal member 13 as shown in FIG. 9.

Pivot plate 28*a* can be used to provide an upper location hole for the third pivot 28, with the lower plate of the rectangular hollow section (RHS) beam or similar used for the longitudinal member 13 of the primary frame 10 providing a lower location hole for the third pivot. The pivot plate 28*a* is assembled into the longitudinal member 13 of the primary frame 10 through a slot 28*b* in a side wall of the longitudinal member 13 and fixed into place through bonding or preferably welding to the opposite side wall of the longitudinal member. Alternatively the pivot plate 28*a* can be slid through the slot 28*b* and through a similar slot in the opposite side wall, then fixed in place. An access hole 28*c* is provided in the top plate of the beam of the longitudinal member 13 to enable the pivot bolt 28*d* (or similar) to be assembled.

The primary frame comprises three RHS beams, the first and second stem portions 11, 12 being welded or otherwise fixed to the ends of the longitudinal member 13. Typically, all three RHS beams are typically formed from metal, with the first and second stems being respectively welded to opposite ends of the longitudinal member at mitred joints. The mitred joints can include a step in the line of the mitre near the inside corner of the joint to prevent a welded join being made in the lower inner surface of the longitudinal member, thus preventing weld from interfering with the path of the pivoting balance member 25.

The pivoting balance member 25 is assembled inside the longitudinal member 13 of the primary frame 10 by being passed through the holes 17 cut through the primary frame 10 at the ends of the longitudinal member 13. The pivoting balance member 25 passes under the pivot plate 28*a* and is fastened into place by the pivot bolt 28*d* or similar fastener which passes through the pivot plate 28*a*, the pivot hole 28*e* in the pivoting balance member 25 and a hole (not shown) in the lower plate of the longitudinal member 13. A nut 28*f* is shown for the pivot bolt 28*d*.

At each end of the pivoting balance member 25, the protruding feature 51 of the interaction arrangement 50 is in this example a flat plate of rounded profile, cut from the lower plate of the rectangular hollow section pivoting balance member 25. Each protruding feature can alternatively be a ball as shown in FIG. 2, cast and then pressed or otherwise fixed into the end of the pivoting balance member.

However, due to the rotation of the pivoting balance member 25 and the rotation of the respective pivoting leg member 21, 22, the protruding feature 51 must interact with the recess 52 of the respective leg member without introducing significant backlash or free-play. To this end, the recess 52 can be tapered in width, being narrower towards the lower end, and the width can accommodate a ball or other protruding feature in a wider starting region. To engage the protruding feature in the wider starting region the pivoting balance member can be resilient deflected upwards at each end. Then with wear of the protruding feature or the recess, the protruding feature slowly engages lower down the tapered recess.

In FIGS. 7 and 8, the first leg member 21 comprises an inner leg portion 21*a*, a sleeve portion 21*b*, the first foot 31 at the end of the first arm portion 41 and the fourth foot 34 at the end of the fourth arm portion 44. The first pivot 26 provides a pivotal connection between the inner leg portion

21*a* of the first pivot leg member 21 and the first stem portion 11 of the primary frame 10. Similarly, the second leg member 22 comprises an inner leg portion 22*a*, a sleeve portion 22*b*, the second foot 32 at the end of the second arm portion 42 and the third foot 33 at the end of the third arm portion 43. The second pivot 27 provides a pivotal connection between the inner leg portion 22*a* of the second pivot leg member 22 and the second stem portion 12 of the primary frame 10. In FIGS. 7 and 8, the first pivot 26 is shown assembled and the second pivot is shown exploded. As an example, the second pivot comprises a pivot hole 27*a* in the second stem portion 12 of the primary frame 10, a pivot hole 27*b* in the inner leg portion 22*a* and a fastener such as the bolt 27*c* and nut 27*d*. As shown in the assembled first pivot 26, the inner leg portion 21*a* is a U-shape of unequal lengths with flanged edges and sits around the first stem portion 11 of the primary frame 10.

The edges of the inner leg portions 21*a*, 22*a* are flanged to radially locate the respective sleeve portion 21*b*, 22*b*. Each sleeve portion 21*b*, 22*b* is axially retained and rotationally located by two bolts 21*c*, 22*c* that pass through holes in the plate fixed at the end of the sleeve portion 21*b*, 22*b* and screw into the lower ends of the respective U-shaped inner leg portion 21*a*, 22*a*, or into nuts welded or otherwise held captive in the lower ends of the inner leg portions 21*a*, 22*a*.

For ease of shipping, for example to enable the support arrangement to be packaged as a "flat pack", the two inner leg portions 21*a*, 22*a* and the first balance member 25 can be assembled into or onto the primary frame 10. This also allows the pivots 26, 27, 28 to be set as required in the factory without requiring users to set fastener torques or loads that effect operation of the mechanism of the support arrangement. For example, the tension in the first and second pivots 26, 27 (of the first and second pivoting leg members 21, 22 to the first and second stem portions 11, 12 of the primary frame 10) can be set to provide a desired level of damping of the mechanism and the third pivot (of the pivoting balance member 25 to the longitudinal member of the primary frame 10) can be set to provide minimal additional damping or friction. Then for final assembly before first use, the sub-assembly of (or integrated) sleeve portion 21*b*, arm portions 41, 44 and feet 31, 34 of the first pivoting leg member can be slid over the inner leg portion 21*a* and fixed (for example bolted) into place and the sub-assembly of (or integrated) sleeve portion 22*b*, arm portions 42, 43 and feet 32, 33 of the second pivoting leg member can be slid over the inner leg portion 22*a* and fixed (for example bolted) into place. Also the braces 14 can be fixed to the primary frame 10.

Figure 10:
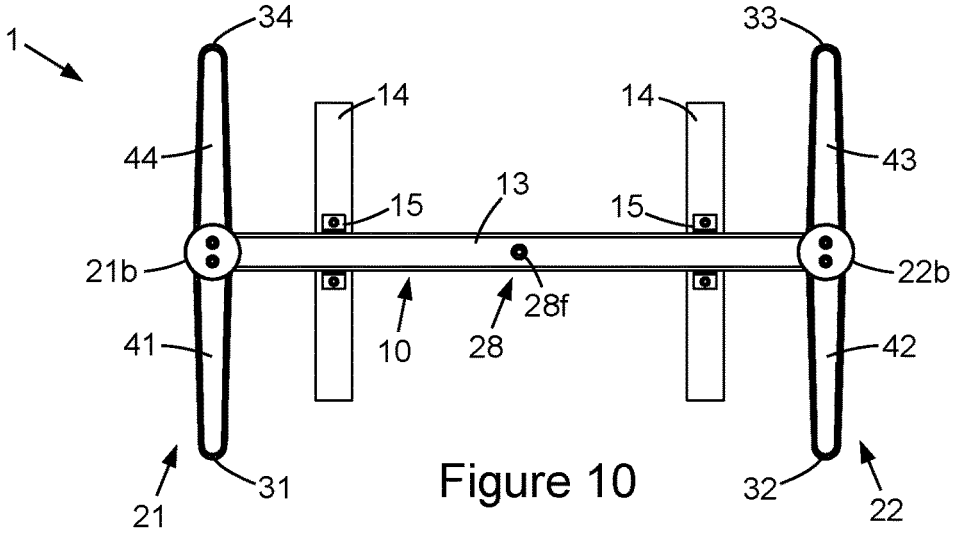
FIG. 10 is a bottom view of the support arrangement of FIG. 7
Figure 11:
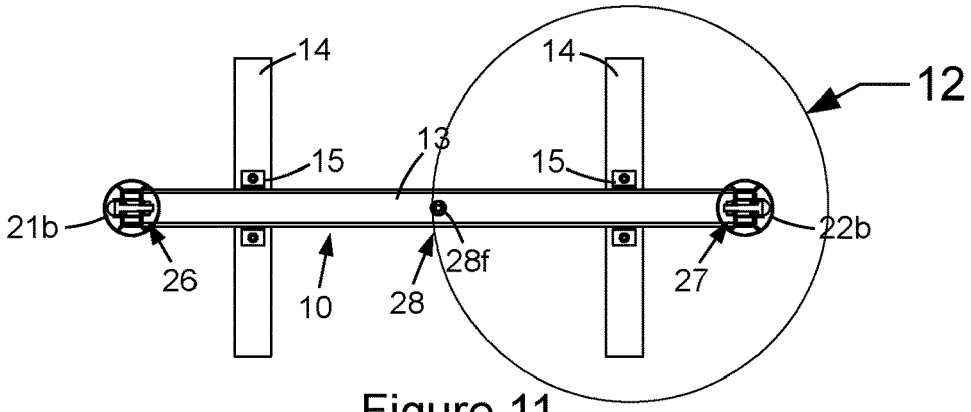
FIG. 11 a cross-sectional view indicated on FIG. 9.

The assembled support arrangement 1 is shown in side view in FIG. 9 and bottom view in FIG. 10. As with FIGS. 7 and 8, the object to be supported, such as a table top, is not shown. FIG. 11 is a cross-sectional view through the support arrangement 1 as indicated in FIG. 9. The cross-section is taken through the (first and second) pivots of the first and second pivoting leg members and FIG. 12 shows the detail of the second pivot 27.

The sleeve portions 21*b*, 22*b* of the pivoting leg members 21, 22 in FIGS. 7 to 12 are shown as cylinders or circular hollow section (CHS) beams. However, these sleeve portions can be of any desirable shape that has an internal space to accommodate the stem portions 11, 12 of the primary frame 10 and the inner leg portions 21*a*, 22*a*. Using sleeve portions that have walls that are not transparent or do not have holes through them allow the first and second pivots 26, 27 to be hidden from view. Indeed the embodiment shown in FIG. 9 hides the stabilising mechanism of the support arrangement, particularly if a non-transparent object such as a table top is being supported.

Figure 12:
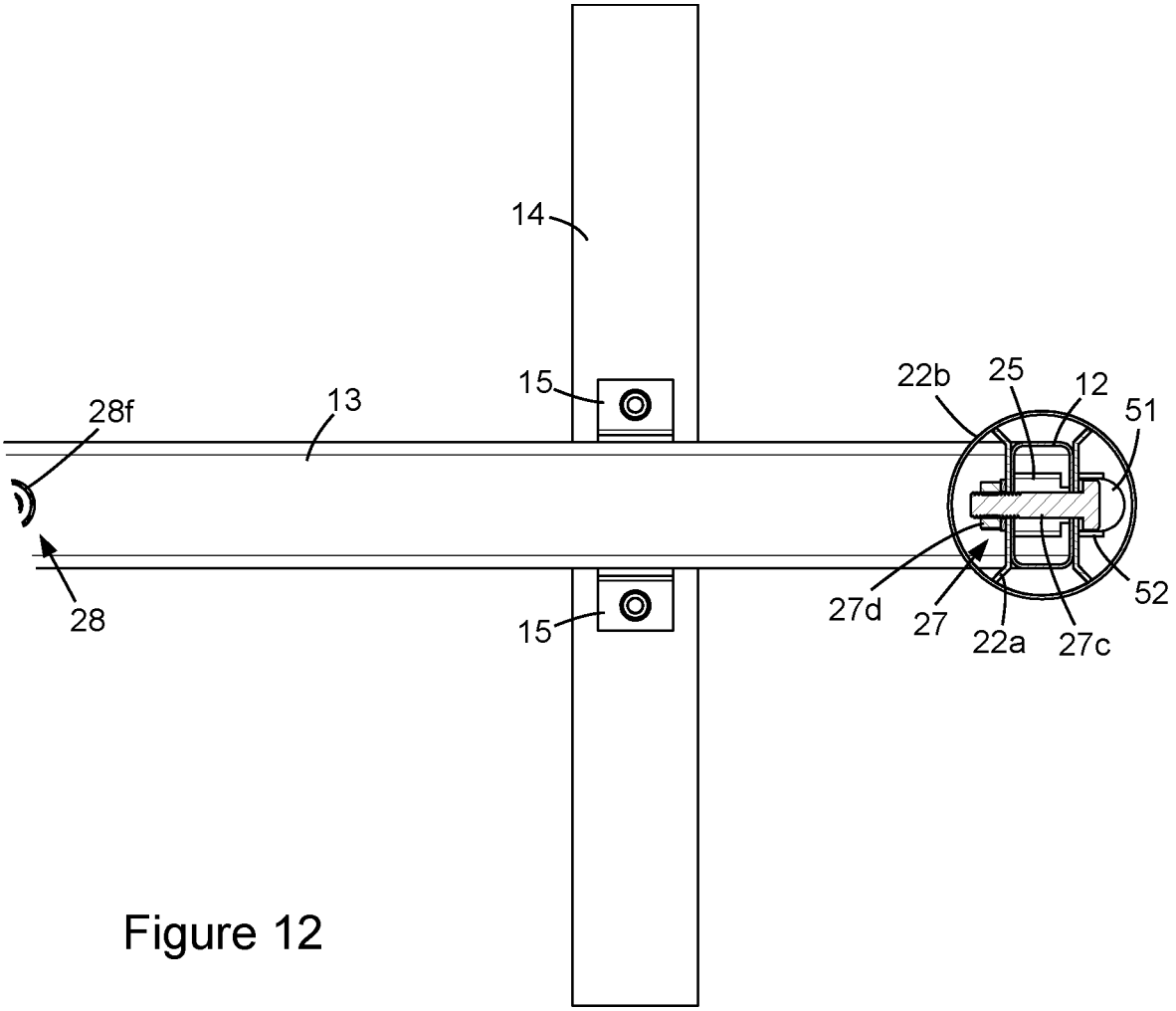
FIG. 12 is a detailed view indicated on FIG. 11.
Figure 13:
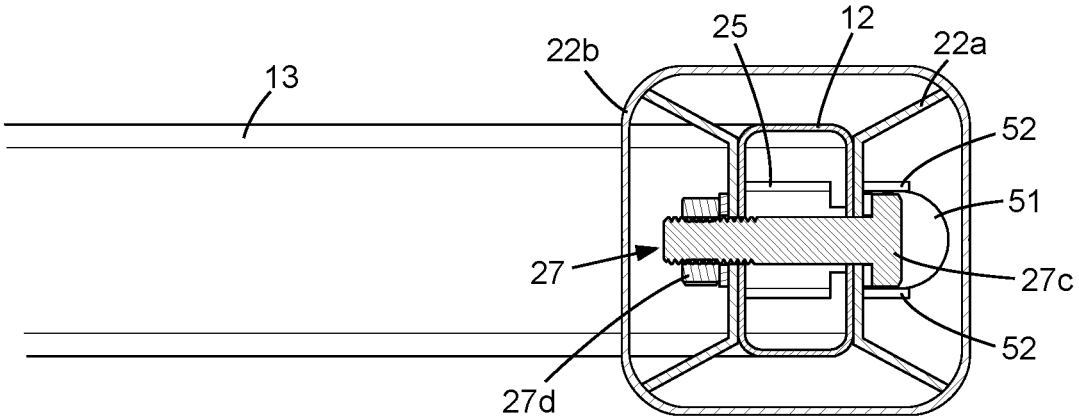
FIG. 13 is a cross-section of a detail through the pivot between a stem portion and pivoting leg member.
Figure 14:
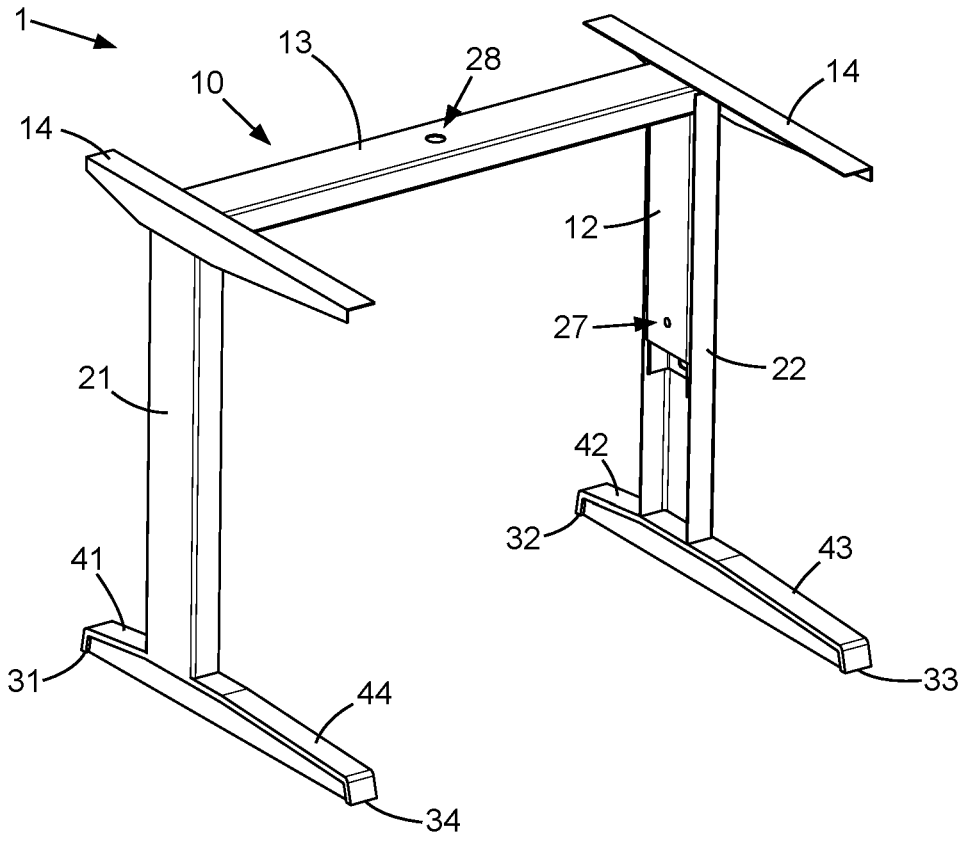
FIG. 14 is a perspective view of a support arrangement according to the present invention.
Figure 15:
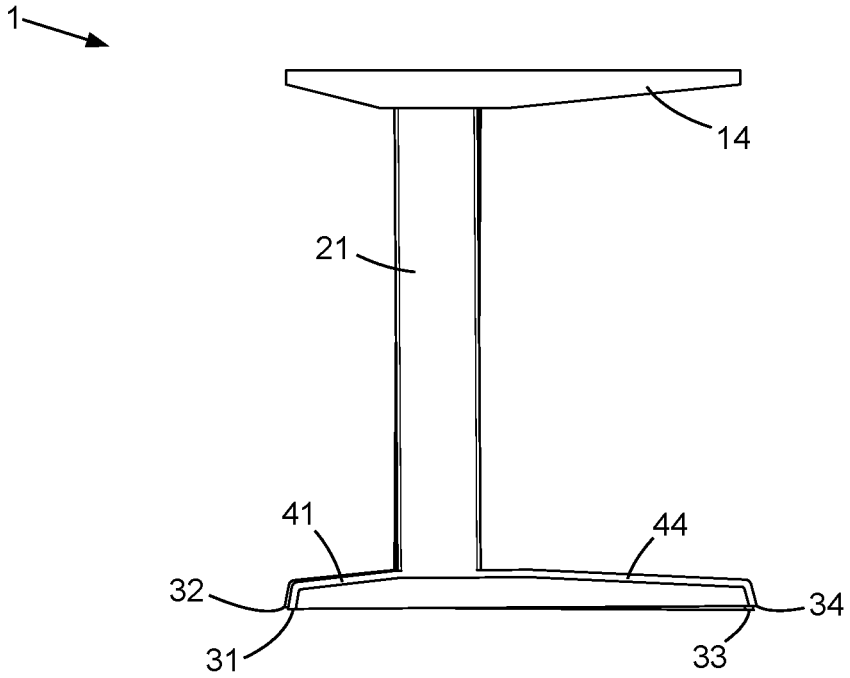
FIG. 15 is an end view of the support arrangement of FIG. 14.
Figure 16:
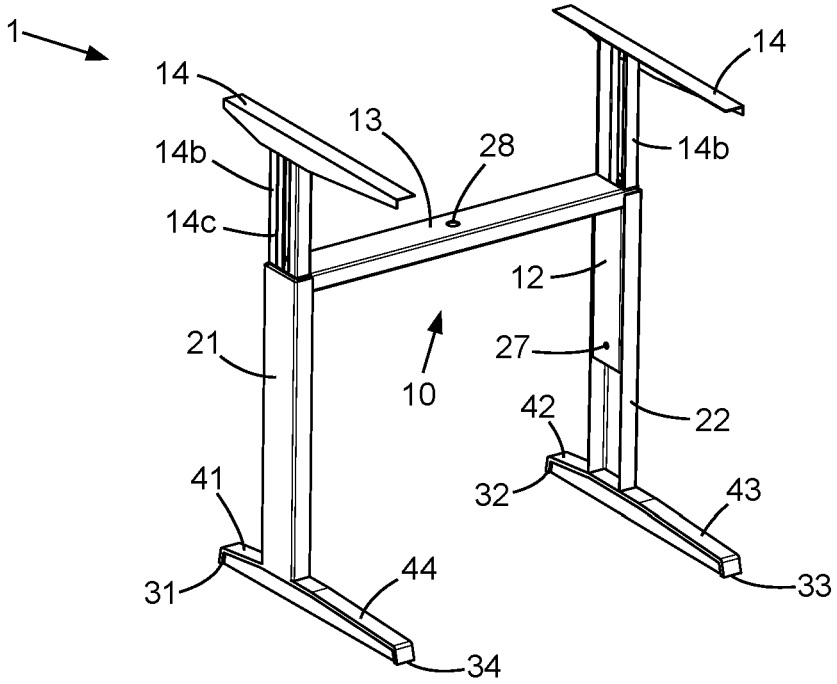
FIG. 16 is a perspective view of the support arrangement of FIG. 14 in an alternate position.
Figure 17:
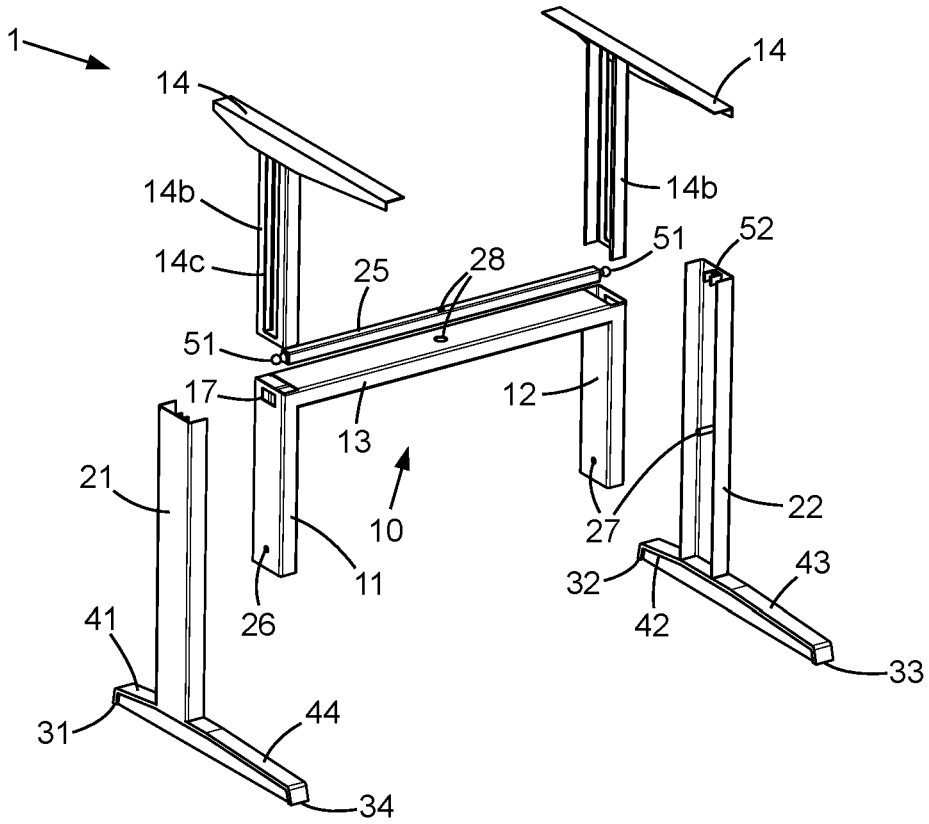
FIG. 17 is an exploded view of the support arrangement of FIG. 14.

FIG. 13 shows an enlarged but similar view to FIG. 12, but the sleeve portion 22*b* in FIG. 12 is square is section, for example being made from a rectangular hollow section (RHS) or square hollow section (SHS) beam or member. In this most enlarged view, the pivoting balance member 25 that is mainly housed within the longitudinal member 13 of the primary frame can be seen through the length of the second stem portion 12 of the primary frame and the protruding feature 51 on the end of the pivoting balance member 25 that protrudes out through the primary frame can also be seen accommodated within or mating with the recess 52 which is fixed to or part of the inner leg portion 22*a* of the second pivoting leg portion.

In the support arrangements of FIGS. 7 to 12, the limit stop which provides a travel limit of the stabilising mechanism of the support arrangement, can be formed in several places individually or together in the support arrangement. For example, the rotation of the pivoting balance member can be limited by interference between the pivoting balance member 25 and the holes 17 through the primary frame 10 at the ends of the longitudinal member 13. However when using this type of limit stop, the loads applied to the support arrangement that require the intervention of the limit stop are passed through the interaction arrangement 50.

So to reduce peak loads applied to the interaction arrangement 50, the limit stop can additionally or alternatively, by provided by interference between one of, or each stem portion 11, 12 of the primary frame 10 and the respective pivoting leg member 21, 22. For example, a limit stop plate can be welded to the base of the stem portion 11, 12 such that when the warp displacement of the stabilising mechanism of the support arrangement reaches a predetermined magnitude, the limit stop plate contacts the stem portion of the respective pivoting leg member such as the inside of the sleeve portion 21*b*, 22*b*. In this case the loads applied to the support arrangement that require the intervention of the limit stop are in part reacted by the first and/or second pivot 26, 27 but they are not passed through the interaction arrangement 50.

The limit stop can additionally or alternatively be provided by a pin fixed to the first and/or second pivoting leg members 21, 22, the pin moving in a slot in the respective stem portion 11, 12 with the travel limit being applied when the pin reaches an end of the slot. Similarly, the pin could be fixed to a stem portion and the slot could be in the respective pivoting leg member. A similar pin and slot arrangement could be provided to limit rotation of the pivoting balance member to limit travel of the mechanism and provide a limit stop, but as with the other balance member travel limit stop above, the interaction arrangement is in the path of forces in the event of a limit stop action.

FIGS. 14 to 17 shows a modification to the support arrangement of FIGS. 1-2 including a height adjustable object braces 14 and first and second pivots 26, 27 that are offset from the midway between the first and fourth or second and third feet (31, 34 or 32, 33). The arrangement is shown slightly articulated in the side view FIG. 8 as the second and third feet 32, 33 are just visible behind the first and fourth feet 31, 34.

The two height adjustable object braces 14 can optionally be joined together by a member (not shown) having at least vertical depth to provide stiffness to locate the braces vertically relative to each other. The braces 14 include at least one vertical member 14*b*, in this example a C-section channel that is able to slide within the respective first or second stem portion 11, 12. The vertical member 14*b* includes a slot 14*c* for the end of the pivoting balance member 25 to through, in use.

In all of the preceding examples of the present invention, the first and second pivots 26, 27 (of the first and second pivoting leg members 21, 22) can preferably be between 15% and 50% of the distance from the average plane of the feet 31, 32, 33, 34 to the plane defined by the top of the support arrangement (such as by the braces 14). More preferably, the first and second pivots 26, 27 are between 20% and 45% and yet more preferably between 25% and 40% and most preferably between 30% and 35% of the distance from the average plane of the feet 31, 32, 33, 34 to the plane defined by the top of the support arrangement.

Figure 18:
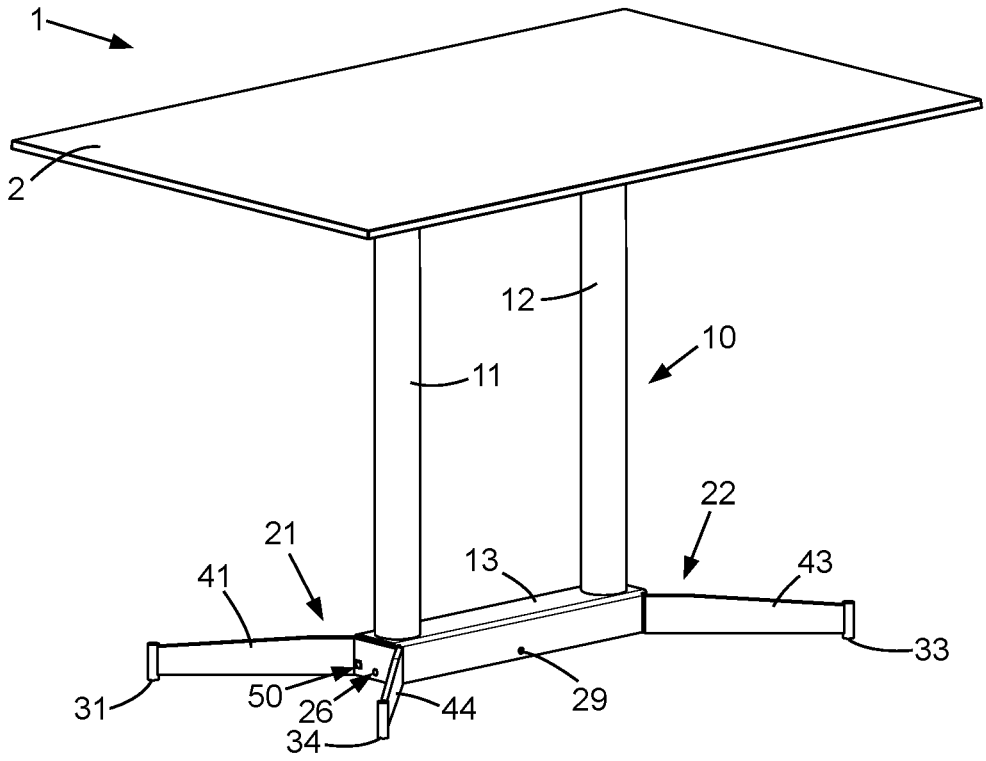
FIG. 18 is a perspective view of a support arrangement according to the present invention.
Figure 19:
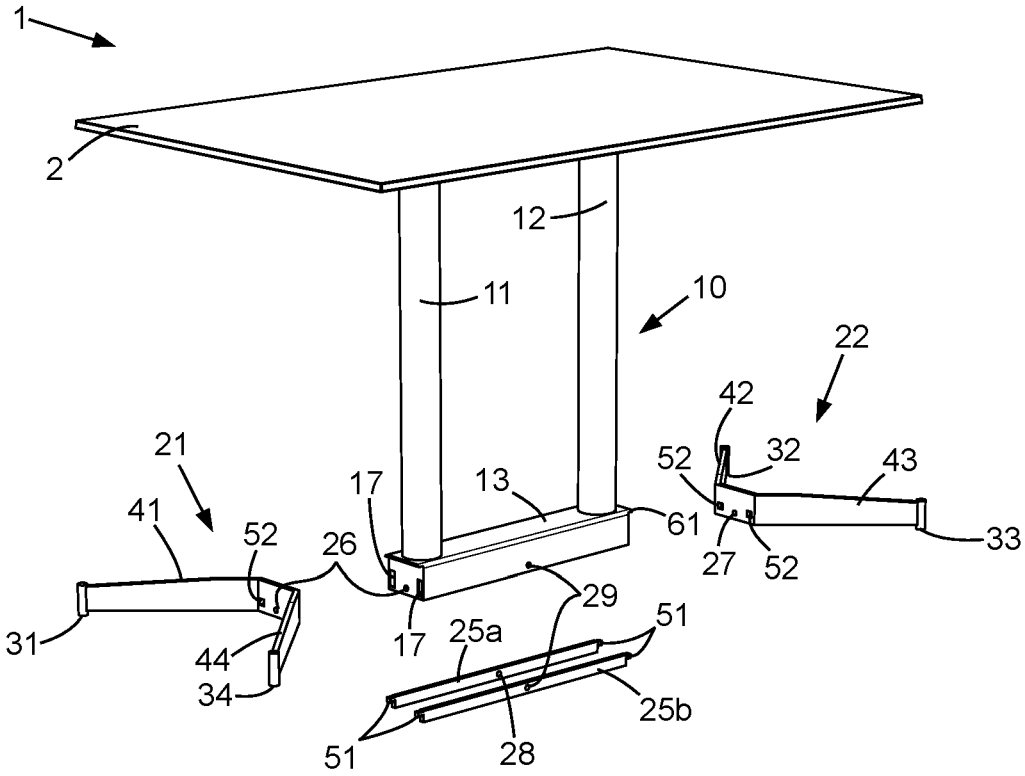
FIG. 19 is an exploded view of the support arrangement of FIG. 18.

In the preceding example of the present invention, the longitudinal member 13 of the primary frame 10 is located at an upper end of the first and second stem portions 11, 12 of the primary frame 10. However, FIGS. 18 and 19 show an arrangement having the longitudinal member 13 of the primary frame nearer ground level, i.e. at a lower end of the first and second stem portions 11, 12 of the primary frame 10. While the same type of balance member and first and second pivoting leg members as in FIG. 1 could be adapted and used, FIGS. 18 and 19 utilise first and second pivoting balance members 25*a*, 25*b* pivotally connected to the primary frame by third and fourth pivots 28, 29. The first and second pivoting leg members are not pivoted to the primary frame at least 20% of the support arrangement height above ground, but instead the first and second pivots 26, 27 are in the end of the longitudinal member 13 and the pivoting leg members 21, 22 do not extend further vertically than the longitudinal member 13. Although the pivoting balance member of FIGS. 1 to 13 (which pivoted in a horizontal plane) has been replaced by the first and second pivoting balance members 25*a*, 25*b* (which pivot in vertical planes) which pivot about the third and fourth pivots 28, 29, these first and second pivoting balance members are again housed within and pass out through holes 17 in both ends of the longitudinal member 13 of the primary frame.

The first and second pivots 26, 27 have pivot axes that are substantially longitudinal and the third and fourth pivots 28, 29 have pivot axes that are substantially lateral. The interaction arrangement 50 comprises a protruding feature 51 on each end of each pivoting balance member 25*a*, 25*b*, which is received in a respective recess 52 in the first and second pivoting leg members 21, 22.

Limit stops to limit the maximum magnitude of warp displacement of the mechanism of the support arrangement can again be provided in a number of individual locations and/or in a combination of locations. For example, the rotation of the first and second pivoting balance members 25*a*, 25*b* can be limited by interference with the edges of the holes 17 through the ends of the longitudinal member 13. The rotation of the first and second pivoting leg members 21, 22 can be limited by interference with an overhanging top plate 61 of the longitudinal member 13 as shown in FIG. 19 and/or a pin and slot arrangement can be used between the pivoting leg members 21, 22 and the primary frame 10.

Figure 20:
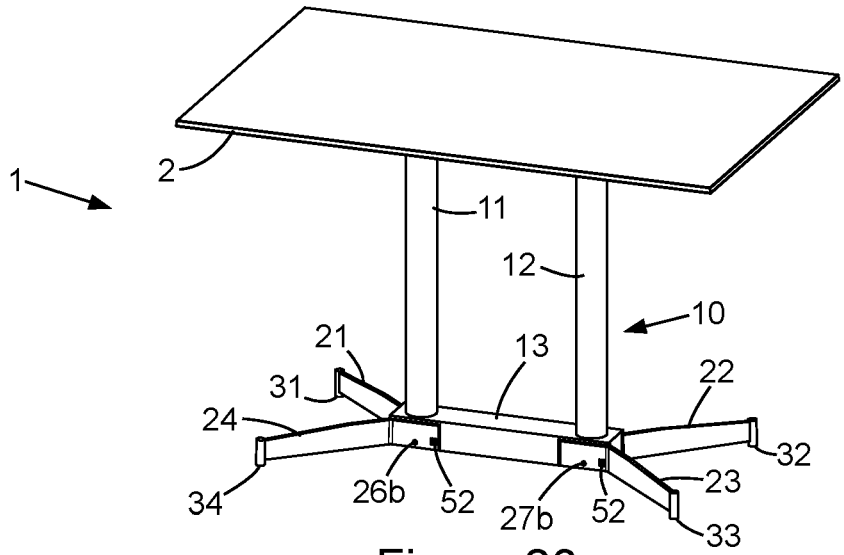
FIG. 20 is a perspective view of a support arrangement according to the present invention.
Figure 21:
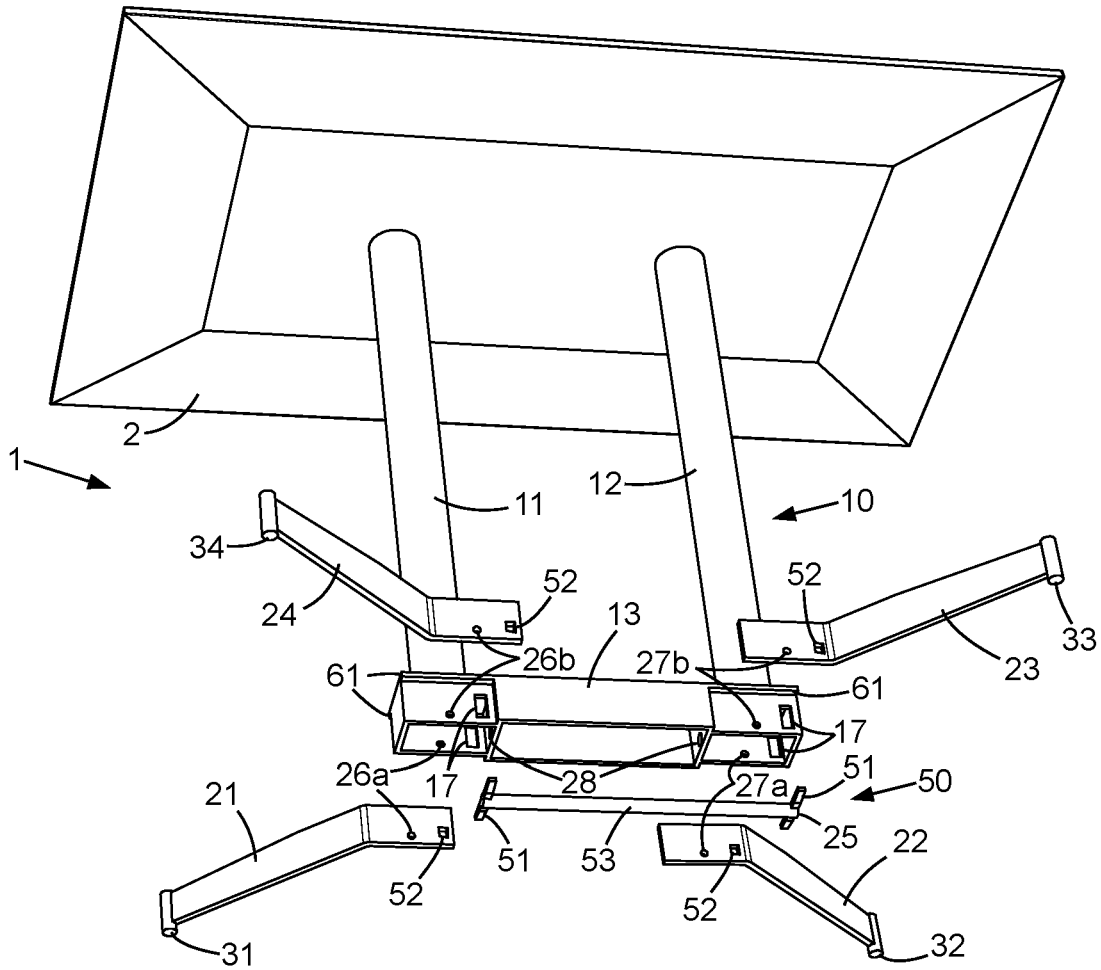
FIG. 21 is an exploded view of the support arrangement of FIG. 20.

FIGS. 20 and 21 show an alternative support arrangement 1 having a respective pivoting leg member 21, 22, 23, 24 for the first, second, third and fourth feet 31, 32, 33, 34, each pivoting leg member pivoting relative to the longitudinal member 13 of the primary frame 10 at a respective pivot 26*a*, 27*a*, 27*b*, 26*b*, being a respective pivot joint having a respective pivot axis. The interaction arrangement 50 includes a pivoting balance member 25 arranged to rotate about a longitudinal rotation axis relative to the primary frame 10. The pivoting balance member 25 includes a first protruding feature 51, which in this case is a lateral beam member, and a second protruding feature 51, which is a similar lateral beam member longitudinally spaced from the first protruding feature, each protruding feature extending through holes 17 through both sides of the longitudinal member 13. Each protruding feature 51 or lateral beam member is connected to the other by a longitudinal torsion member 53 such as a rod, the longitudinal torsion member preferably having a high torsional stiffness so undesirable resilience is not added to the mechanism of the support arrangement 1. Each protruding feature 51 or lateral beam member includes a first engaging region located on an opposite side of the longitudinal rotation axis to a second engaging region in plan view. The first and fourth pivoting leg members 21, 24 include a matching engagement region or recess 52 located on an opposite side of the first or fourth pivot axis of the respective pivot 26*a*, 26*b* to the respective first or fourth foot 31, 34 in plan view and the second and third pivoting leg members 22, 23 include an engagement region or recess 52 located between the second or third pivot axis of the respective pivot 27*a*, 27*b* and the respective second or third foot 32, 33 in plan view.

The support arrangement in FIGS. 20 and 21 is shown supporting a table top 2, although any suitable object can be supported. When the support arrangement 10 of FIG. 21 is assembled as shown in FIG. 20, the pivoting balance member 25 is located within the pivots 28 in the lateral walls of the longitudinal member. These pivots can be arranged in any known way relative to the longitudinal member 13 and can include saddle portions (not shown) that enable to the pivoting balance member 25 to be fitted into the longitudinal member from underneath. Using clamps that allow the pivoting balance member 25 to be fitted to the longitudinal member also allow the pivoting balance member to be manoeuvred into place by passing the protruding features 51 largely through the holes 17 on one side of the longitudinal member, swinging it upwards, then sliding it back so the other ends of the protruding features 51 pass through the holes 17 on the opposite side of the longitudinal member 13. With the pivoting balance member in place, with the first and second engagement regions of each protruding feature 51 or lateral beam member protruding out through the holes 17 in the longitudinal member 13, the pivoting balance member 52 can be clamped in place such that it is able to rotate within the pivots 28.

So, the first engagement region of the first lateral beam member engages in use with the engagement region of the first pivoting leg member, the first engagement region of the second lateral beam member engages in use with the engagement region of the second pivoting leg member, the second engagement region of the second lateral beam member engages in use with the engagement region of the third pivoting leg member, and the second engagement region of the first lateral beam member engages in use with the engagement region of the fourth pivoting leg member.

An overhanging top plate 61 is shown on the longitudinal member 13 extending out above the pivoting legs 21, 22, 23, 24. This can provide a limit stop and/or the height of the holes 17 through which the protruding features 51 extend can be used to limit the travel of the mechanism and provide a limit stop to the support arrangement.

Modifications and variations as would be apparent to a skilled addressee are deemed to be within the scope of the present invention.

The invention claimed is:

1. A support arrangement for an object, the support arrangement comprising;

a primary frame, the primary frame including a first stem portion, a second stem portion and a longitudinal member, the second stem portion being longitudinally spaced from the first stem portion, the first and second stem portions being attached to the longitudinal member;

first, second, third and fourth feet, each said foot attached, fixed or connected to at least one of at least three pivoting members;

in use, the first and fourth feet being laterally spaced and positioned towards a first end of the primary frame and the second and third feet being laterally spaced and positioned towards a second end of the primary frame, the second foot being longitudinally spaced from the first foot, the third foot being longitudinally spaced from the fourth foot;

at least one interaction arrangement providing interaction between the at least three pivoting members and being arranged such that when the first foot moves in a first upwards or downwards direction relative to the primary frame the second foot moves in at least a second direction relative to the primary frame, the second direction being an opposite direction relative to the first direction, and the third foot moves in at least the first direction and the fourth foot moves in at least the second direction, wherein, in use, beyond an operational range of rotation of at least one of the three pivoting members, rotation of the three pivoting members is limited by interference between at least one of the pivoting members and the primary frame.

2. A support arrangement as claimed in claim 1 wherein the first foot and the third foot are on opposing sides of a virtual straight line extending between the second foot and the fourth foot.

3. A support arrangement as claimed in claim 1 wherein the at least three pivoting members comprise a first pivoting leg member pivotally connected to the primary frame at a first pivot, a second pivoting leg member pivotally connected to the primary frame at a second pivot and at least a first pivoting balance member pivotally connected to the primary frame at a third pivot;

the first pivot being located at or towards the first end of the primary frame, the second pivot being located at or towards the second end of the primary frame and the third pivot being located between the first and the second pivot, the first foot being fixed to the first pivoting leg member, the second foot being fixed to the second pivoting leg member, the at least one interaction arrangement providing interaction between the first pivoting leg member and the first pivoting balance member and between the second pivoting leg member and the first pivoting balance member such that rotation of one of said three pivoting members results in a rotation of each of the three pivoting members.

4. A support arrangement as claimed in claim 3 wherein the third foot is fixed to the second pivoting leg member, and the fourth foot is fixed to the first pivoting leg member.

5. A support arrangement as claimed in claim 4 wherein the first and second pivots are offset from midway between the first and fourth or second and third feet.

6. A support arrangement as claimed in claim 3 wherein, in use, the first pivot has a first pivot axis extending at least longitudinally, the second pivot has a second pivot axis extending at least longitudinally, and the third pivot has either a third pivot axis extending at least vertically or a third pivot axis extending at least laterally.

7. A support arrangement as claimed in claim 3 wherein the at least one interaction arrangement includes a protrusion slot arrangement between the first pivoting leg member and the first pivoting balance member either comprising a protrusion on the first pivoting leg member engaging with a slot, hole or recess in the first pivoting balance member; or comprising a protrusion on the first pivoting balance member engaging with a slot, hole or recess in the first pivoting leg member.

8. A support arrangement as claimed in claim 3 wherein the at least one interaction arrangement includes a protrusion arrangement between the first pivoting leg member and the first pivoting balance member either comprising at least one protrusion extending from the first pivoting leg member to bear on the first pivoting balance member or comprising at least one protrusion extending from the first pivoting balance member to bear on the first pivoting leg member.

9. A support arrangement as claimed in claim 3 wherein the longitudinal member of the primary frame is located at an upper end of the first and second stem portions of the primary frame.

10. A support arrangement as claimed in claim 3 wherein the longitudinal member of the primary frame is located at a lower end of the first and second stem portions of the primary frame.

11. A support arrangement as claimed in claim 10 wherein the at least a first pivoting balance member includes a first pivoting balance member pivotally connected to the longitudinal member by the third pivot and a second pivoting balance member pivotally connected to the longitudinal member by a fourth pivot, the third and fourth pivots having pivot axes being aligned substantially horizontally in use and substantially perpendicular to first and second pivot axes of the respective first and second pivots.

12. A support arrangement as claimed in claim 1 wherein the at least three pivoting members comprise a first pivoting leg member pivotally connected to the primary frame at a first pivot, a second pivoting leg member pivotally connected to the primary frame at a second pivot, a third pivoting leg member pivotally connected to the primary frame at a third pivot and a fourth pivoting leg member pivotally connected to the primary frame at a fourth pivot;

each respective first, second third or fourth pivoting leg member including the respective foot;

each respective first, second, third and fourth pivot having a respective pivot axis, each said pivot axis being substantially laterally oriented, the first and fourth pivot axes being substantially aligned and the second and third pivot axes being substantially aligned;

the interaction arrangement comprising a first pivoting balance member arranged to rotate about a longitudinal rotation axis relative to the primary frame, the first pivoting balance member including a first lateral beam member and a second lateral beam member longitudinally spaced from the first lateral beam member, each lateral beam member including a first engaging region located on an opposite side of the longitudinal rotation axis to a second engaging region in plan view;

the first and fourth pivoting leg members including an engagement region located on an opposite side of the first or fourth pivot axis to the respective first or fourth foot in plan view; the second and third pivoting leg members including an engagement region located between the second or third pivot axis and the respective second or third foot in plan view;

the first engagement region of the first lateral beam member engaging in use with the engagement region of the first pivoting leg member, the first engagement region of the second lateral beam member engaging in use with the engagement region of the second pivoting leg member, the second engagement region of the second lateral beam member engaging in use with the engagement region of the third pivoting leg member, and the second engagement region of the first lateral beam member engaging in use with the engagement region of the fourth pivoting leg member.

13. A support arrangement as claimed in claim 1 wherein, beyond the operational range of rotation, the interference is between a first pivoting leg member and the first stem portion of the primary frame and/or between a second pivoting leg member and the second stem portion of the primary frame.

14. A support arrangement as claimed in claim 1 wherein, beyond the operational range of rotation, the interference is between a first pivoting balance member and the longitudinal member of the primary frame.

15. A support arrangement as claimed in claim 1 wherein the object to be supported is a table top.

16. A support arrangement as claimed in claim 15 wherein the table top is height adjustable.

17. A twin pedestal support for a table top, the twin pedestal support comprising a primary frame, three pivoting members, and first, second, third and fourth feet;

the primary frame including a first stem portion at a first end of the primary frame, a second stem portion at a second end of the primary frame and a longitudinal member connected to the first stem portion and to the second stem portion;

the first, second, third and fourth feet each being connected to one of the three pivoting members;

in use, the first and fourth feet being positioned towards the first end of the primary frame and the second and third feet being positioned towards the second end of the primary frame, the second foot being longitudinally spaced from the first foot, the third foot being longitudinally spaced from the fourth foot and being laterally and longitudinally spaced from the first foot, at least one interaction arrangement providing interaction between the at least three pivoting members and being arranged such that when the first foot moves in a first upwards or downwards direction relative to the primary frame the second foot moves in at least a second direction relative to the primary frame, the second direction being an opposite direction relative to the first direction, and the third leg moves in the first direction and the fourth leg moves in at least the second direction, the first foot and the third foot being on opposing sides of a virtual straight line extending between the second foot and the fourth foot, wherein, in use, beyond an operational range of rotation of at least one of the three pivoting members, rotation of the three pivoting members is limited by interference between at least one of the pivoting members and the primary frame.

18. A twin pedestal support for a table top, the twin pedestal support comprising a primary frame, three pivoting members, and first, second, third and fourth feet;

the primary frame including a first stem portion at a first end of the primary frame, a second stem portion at a second end of the primary frame and a longitudinal member connected to the first stem portion and to the second stem portion;

in use, the first and fourth feet being positioned towards the first end of the primary frame and the second and third feet being positioned towards the second end of the primary frame, the second foot being longitudinally spaced from the first foot, the third foot being longitudinally spaced from the fourth foot and being laterally and longitudinally spaced from the first foot, the three pivoting members comprise a first pivoting leg member pivotally connected to the primary frame at a first pivot, a second pivoting leg member pivotally connected to the primary frame at a second pivot and a pivoting balance member pivotally connected to the primary frame at a third pivot;

the first pivot being located at or towards the first end of the primary frame, the second pivot being located at or towards the second end of the primary frame and the third pivot being located between the first and the second pivot, the first foot being fixed to the first pivoting leg member, the second foot being fixed to the second pivoting leg member, at least one interaction arrangement provides interaction between the first pivoting leg member and the pivoting balance member and between the second pivoting leg member and the pivoting balance member such that rotation of one of said three pivoting members results in a rotation of each of the three pivoting members, the first foot and the third foot being on opposing sides of a virtual straight line extending between the second foot and the fourth foot, wherein, in use, beyond an operational range of rotation of at least one of the three pivoting members, rotation of the three pivoting members is limited by interference between at least one of the pivoting members and the primary frame.

* * * * *